US009688514B2

(12) United States Patent
Horton

(10) Patent No.: US 9,688,514 B2
(45) Date of Patent: Jun. 27, 2017

(54) SECTION OF STAIRLIFT GUIDE RAIL AND KIT

(71) Applicant: Island Mobility Ltd., Newport Isle of Wight (GB)

(72) Inventor: Robert George Horton, Ryde (GB)

(73) Assignee: ISLAND MOBILITY LTD, Newport Isle of Wight (GB)

( * ) Notice: Subject to any disclaimer, the term of this patent is extended or adjusted under 35 U.S.C. 154(b) by 0 days.

(21) Appl. No.: 15/026,567

(22) PCT Filed: Sep. 23, 2014

(86) PCT No.: PCT/GB2014/052891
§ 371 (c)(1),
(2) Date: Mar. 31, 2016

(87) PCT Pub. No.: WO2015/052489
PCT Pub. Date: Apr. 16, 2015

(65) Prior Publication Data
US 2016/0236906 A1 Aug. 18, 2016

(30) Foreign Application Priority Data
Oct. 9, 2013 (GB) ..... 1317848.8

(51) Int. Cl.
*B66B 9/08* (2006.01)

(52) U.S. Cl.
CPC ..... *B66B 9/0846* (2013.01)

(58) Field of Classification Search
CPC ..... B66B 9/0846
See application file for complete search history.

(56) References Cited

U.S. PATENT DOCUMENTS 3,814,027 A * 6/1974 Vice ..... B66B 9/0846 104/247
2005/0224293 A1* 10/2005 Molnar ..... B66B 9/0846 187/200
2010/0064835 A1 3/2010 Luckett
2012/0048652 A1 3/2012 DiGiovanni et al.

FOREIGN PATENT DOCUMENTS

DE EP 0287070 A1 * 10/1988 ..... F16B 7/042
EP 0809599 A1 12/1997
EP 1413541 A1 4/2004
FR 2468022 A1 4/1981
(Continued)

OTHER PUBLICATIONS

International Preliminaty Report on Patentability, issued Oct. 15, 2015, for the International Application PCT/GB/2014/052891.
(Continued)

*Primary Examiner* — William E Dondero
*Assistant Examiner* — Diem Tran
(74) *Attorney, Agent, or Firm* — Procopio, Cory, Hargreaves & Savitch LLP

(57) ABSTRACT

A section of stairlift guide rail having two holes for attaching to another section of stairlift guide rail is described. The two holes are positioned symmetrically about a point along one edge of the section, wherein at least one of the two holes is further configured to have a bracket for mounting the section attached thereto.

19 Claims, 14 Drawing Sheets

(56) References Cited

FOREIGN PATENT DOCUMENTS

| | | | |
|---|---|---|---|
| GB | 2174362 | A | 11/1986 |
| WO | 97/26207 | A | 7/1997 |
| WO | 97/45354 | A | 12/1997 |
| WO | 2007/046690 | A1 | 4/2007 |
| WO | 01/32543 | A1 | 5/2011 |
| WO | 2011-064582 | | 6/2011 |
| WO | 2011/064582 | A1 | 6/2011 |
| WO | 2013129923 | A1 | 9/2013 |

OTHER PUBLICATIONS

Search Report Under Section 17, issued on Aug. 11, 2014, for International Application No. GB1317848.8.
International Search Report, issued Dec. 23, 2014, for International Application PCT/GB2014/052891.
Written Opinion of the International Searching Authority, issued Apr. 16, 2015, for International Application PCT/GB2014/052891.
Examination report issued in copending Canadian application No. 2,920,804 on Apr. 13, 2016 in 3 pages.
Examination report issued in copending New Zealand application No. 718785 on Apr. 26, 2016 in 2 pages.
Examination report issued in copending Australian application No. 2014333603 on Apr. 26, 2016 in 5 pages.

* cited by examiner

SECTION OF STAIRLIFT GUIDE RAIL AND KIT

BACKGROUND

Field of the Disclosure

The present invention relates in general to a section of stairlift guide rail, and a kit for the assembly of a stairlift guide rail.

Description of the Related Art

The "background" description provided herein is for the purpose of generally presenting the context of the disclosure. Work of the presently named inventors, to the extent it is described in the background section, as well as aspects of the description which may not otherwise qualify as prior art at the time of filing, are neither expressly or impliedly admitted as prior art against the present invention.

Due to the increasingly elderly population and the growing demand for people to stay in their own homes, or return home while having medical treatment, there is an increased demand for stair lifts in domestic housing. This equipment is usually only required for a short period of time.

Traditionally, stairlifts have a rail installed on a staircase and a motorised stairlift unit is provided. The motorised stairlift unit travels up and down the rail to transfer the person with mobility issues up and down the stairs.

Many of the stairlifts have their rail custom made to fit the particular dimensions of a staircase in a house.

Once the utility of the stairlift ceases, the rail is unable to be used in other houses with different dimensions of staircase. This makes the stairlift expensive to install as each rail has to be custom made. Further, it may be difficult or not possible to re-use the guide rails and so is not environmentally friendly.

Such custom rails are made of several custom made lengths of rails of varying shapes such as a straight section to go up a straight section of a flight of stairs and a curved section to go round a curved section of a flight of stairs. These bespoke lengths are made off-site many with mounting brackets being welded onto the guide rail at appropriate positions and delivered to a house for assembly on site. As these sections are bespoke, the "lead-time" (that is the time from survey to eventual installation) may be many weeks.

WO2011/064852 describes a kit for the assembly of a guide rail for a stairlift. This disclosure provides a "kit" comprised of many standard components. This kit of many standard components is then assembled on site. One problem with the guide rail in this document is that the kit comprises many sections with each section being specific for left and right hand curves as well as sections having numerous different angles of curvature. According to this document, a kit would typically comprise 40 curved sections to account for the degree and direction of curvature. This makes the kit very difficult to fit and also requires a large number of different component parts.

It is a aim of embodiments of the present disclosure to address at least these issues.

SUMMARY

There is described a section of stairlift guide rail having two holes for attaching to another section of stairlift guide rail, wherein the two holes are positioned symmetrically about a point along one edge of the section, wherein at least one of the two holes is further configured to have a bracket for mounting the section attached thereto.

This is advantageous because such an arrangement allows the stairlift guide rail to be used on either left or right handed bends. This improves the modular arrangement of the stairlift guide rail.

The section of stairlift guide rail may have a circular cross-section.

The section may further comprise a rack having a plurality of rack holes, whereby the rack holes define the smallest distance traveled by a stairlift and further whereby the centre of each of the two holes align with the centre of a rack hole.

The stairlift guide rail section may be configured to receive a spigot which attaches the section to the other section.

One of the two holes may be configured to align with a corresponding hole in the spigot, the one hole being configured to receive a securing element which engages the hole in the spigot.

The section may have a horizontal or vertical or helical curvature or is straight.

A kit for the assembly of a stairlift guide rail comprising a plurality of sections according to any one of the above is envisaged.

The kit may further comprise a light tube configured to extend along the length of section and having a lighting element configured to align with one of the two holes.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
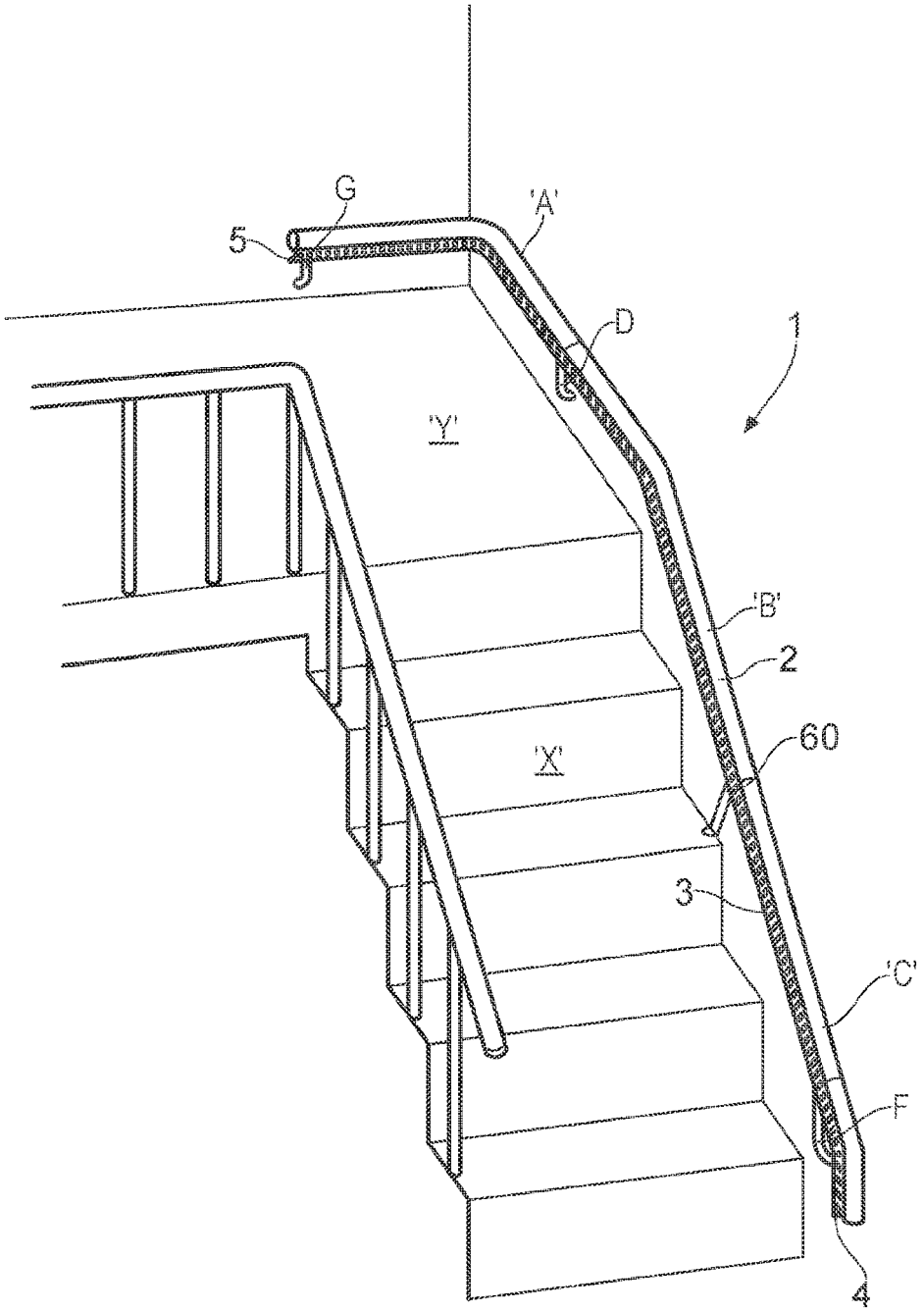
FIG. 1 shows a view of a flight of stairs with a rail attached and held in place by mounting brackets.

Referring now to the drawings, wherein like reference numerals designate identical or corresponding parts throughout the several views.

Referring to FIG. 1 there is shown a staircase X with a landing Y at the top extending off to the left. On the side of the flight of stairs is a stairlift rail 1 having a shaft 2 on which a stairlift unit (not shown) rides. Additionally provided on the stairlift rail 1 is a rack 3 extending along the shaft length below the shaft to engage with the drive pinion on the stairlift unit. The rack is comprised of a plurality of rack holes which engage with the respective pinion on the stairlift unit. The rack holes therefore define the smallest distance that would be traveled by a stairlift.

The rail 1 is made of three sections A, B, C each of different shape joined together with an internal sleeve when a rail is installed in a home. In the following, the internal sleeve is called a spigot and will be described with reference to FIG. 5. Additionally shown in FIG. 1 are a number of mounting brackets. These mounting brackets are labelled D, G, F and 60. The mounting bracket G supports the end of the rail and is secured to the landing. This allows the male projection or the female recess that protrude past the end of the rail to be located into the bracket. Mounting bracket D mounts the guide rail 1 to the wall. Mounting bracket F secures to the bottom landing but allows the male projection or the female recess that protrude past the end of the rail to be located into the bracket. However, mounting bracket 60 mounts the guide rail to the stair. The mounting brackets provide support to the stairlift rail and holds the stairlift rail firmly in place.

Figure 2:
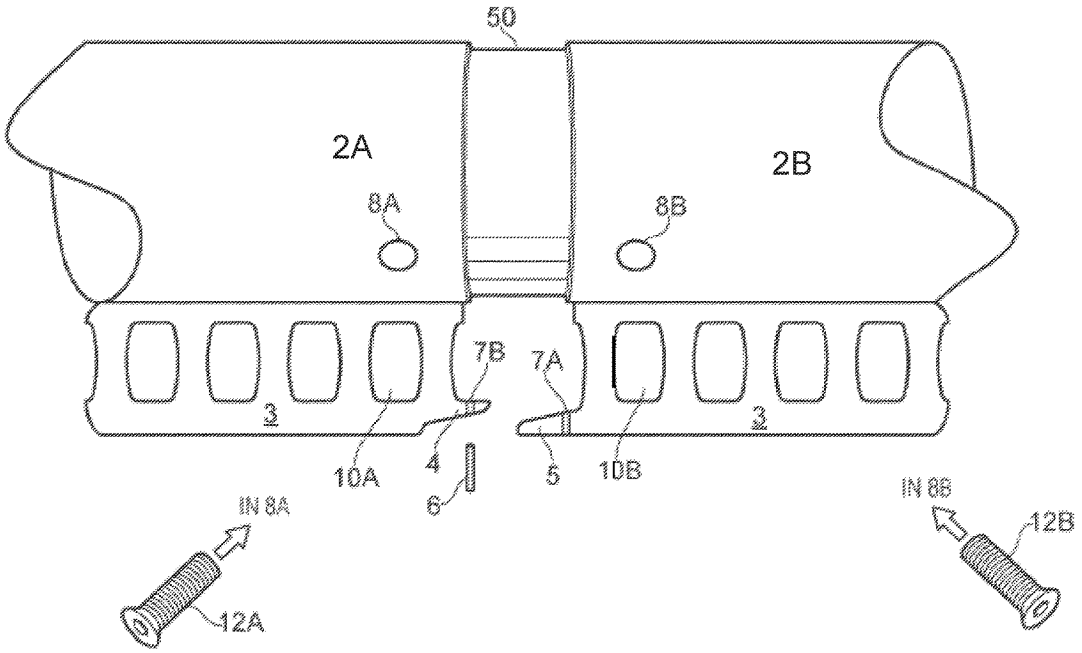
FIG. 2 shows the joining of two sections according to embodiments.
Figure 3:
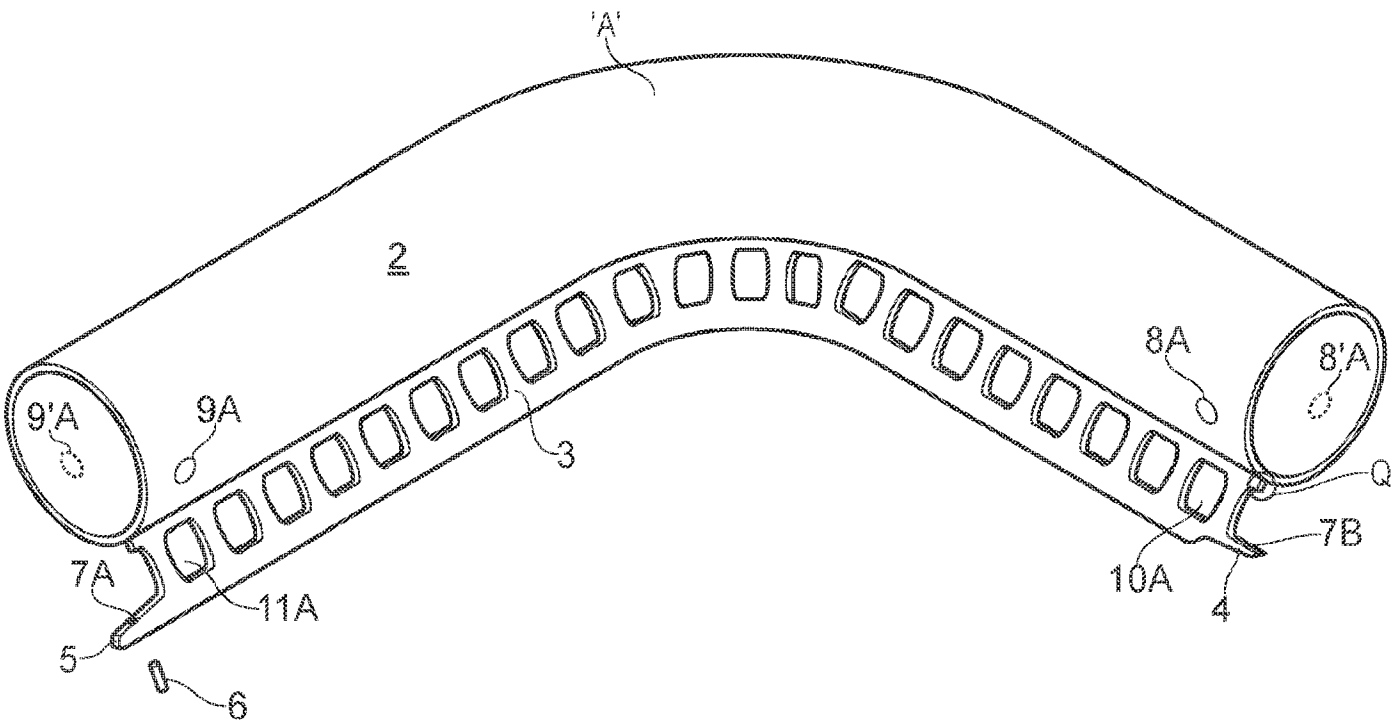
FIG. 3 shows a section having a horizontal curvature according to embodiments.

FIGS. 2 and 3 show the universal position of the first tooth and the open rack hole. Therefore the end of the rail shaft section 2A and the shaft end of section 2B meet at the centre line of the new rack hole that will be created when the two sections of rail are joined together. On one end of the rack 3 on the section 2A is a female recess 4. Located on the other end of the rack 3 on the section 2B is a male projection 5. When the two sections are joined, the female recess 4 on the rack of a first section accepts a male projection on the rack of a second section. A pin 6 is inserted in rack holes 7A, 7B to join the male projection and the female recess together. This ensures accurate positioning of the rack 3 at the join of the first section and the second section.

Additionally shown in FIG. 2 is a shaft hole within the guide rail shaft 2. The shaft hole 8A in section A is large enough to receive securing screw 12A therein. Similarly, a shaft hole 8B exists in section B and is configured to receive securing screw 12B therein. Although a securing screw may be used, any kind of securing element, such as a securing bolt or the like may be used.

The centre of the shaft hole 8A is aligned with the centre of the rack hole 10A located on section A. As already noted, the rack hole defines the smallest distance that the stairlift can travel. Similarly, shaft hole 8B in section B is aligned with the centre of rack hole 10B. Specifically, the centre of shaft hole 8B is aligned with the centre of rack hole 10B. By aligning the centre of shaft hole 8A with the centre of rack hole 10A and by aligning the centre of shaft hole 8B with the centre of rack hole 10B, the smallest available size of segment of the guiderail is possible. In this case, the smallest length of rail can be one rack hole. In other words, this provides flexibility for making short sections available during installation. This may be particularly useful when installing the guiderail around architectural features such as newel posts. As would also be appreciated, when this one hole section of rail is added to the end of a rail section it creates an additional hole. So, when the one hole section is situated between two rail sections it creates three holes. Although the Figures show that the width of the shaft holes is substantially the same as the width of the rack hole, the disclosure is not so limited.

Also in FIG. 2, a spigot 50 which is used to connect and attach section A and section B of the guide rails together is briefly shown. This will be described in more detail with reference to FIG. 5. However, it is noted that the spigot 50 contains receiving holes which, when sections A and B are joined, align with shaft holes 8A and 8B into which respective securing elements 12A and 12B are fastened. This secures the sections A and B into position.

Referring now to FIG. 3, a section similar to section A from FIG. 1 is shown in more detail. Specifically, at each end of section A, a pair of shaft holes is shown. In particular, in FIG. 3, at the female recess end 4, the right hand side of section A is shown a first shaft hole 8A and a second shaft hole 8A'. The centre of both of these shaft holes is aligned with the centre of rack hole 10A. Further, the two shaft holes 8A and 8A' are symmetrical about a point on the edge of the section. In FIG. 3, the shaft holes 8A and 8A' are symmetrical about a point Q. Point Q in FIG. 3 is a point on the guide rail shaft directly below which is located the rack. However, as would be appreciated, the disclosure is not so limited. As will be explained, the provision of symmetrically providing the shaft holes 8A and 8A' about a point on an edge of the guide rail shaft allows section A to be used as a left or right hand curvature section. This reduces the number of different shaped sections required in any kit and improves the modular nature of the guide rail assembly.

Additionally shown in FIG. 3 is a second pair of shaft holes 9A and 9A'. These are located at the male projection end 5, (the left hand side of section A) and are provided where a further section of guiderail (or end cap) will be attached. Similar to the two shaft holes 8A and 8A', the second pair of shaft holes 9A and 9A' are located symmetrically about a point along one edge of the section. In embodiments, the second pair of shaft holes 9A and 9A' are also symmetrically located the point where the rack is attached to the guide rail. Additionally, each of the second shaft holes 9A and 9A' have centres that are aligned with rack hole 11A and are of the same width as rack hole 11A. Of course, the disclosure is not limited to this specific arrangement and the second shaft holes 9A and 9A' can be located symmetrically about any point.

It will now be explained how to use of section A as a left hand or right hand curvature section. If it were decided to use the rail length A of FIG. 1 on a staircase which had a mirror shape (i.e. with a landing going off to the right) section A could be rotated anticlockwise through 90° C. (see FIG. 3). In other words, shaft holes 8A and 8A' would be at the left hand side of FIG. 3 and second shaft holes 9A and 9A' would be located at the right hand side of FIG. 3. Of course, once turned, section A could not connect to section B because the end of section B would not have a male projection 4 and the end of section A would also have male projection 4. However, as section B is a straight piece of section, this too would be rotated to enable the male projection of section A to engage with the female recess of section B. In other words, Section A could be rotated anticlockwise through a ninety degree angle (see FIG. 3) to change it from a right hand curved section to a left hand curved section. Section A can be used as an internal curved section or an external section of rail. When Section A is changed from a left hand curve to a right hand curved section the sequence of the male 5 and female 4 rack ends change. This is the same when the horizontal curved section (Section A) is reversed.

Of course, the skilled person will appreciate that the same will also occur when the section is a vertical up angled bend or vertical down angled bend 81 (such as section B or C) or indeed a helical bend section rail (such as used on so-called fan stairs).

Figure 8:
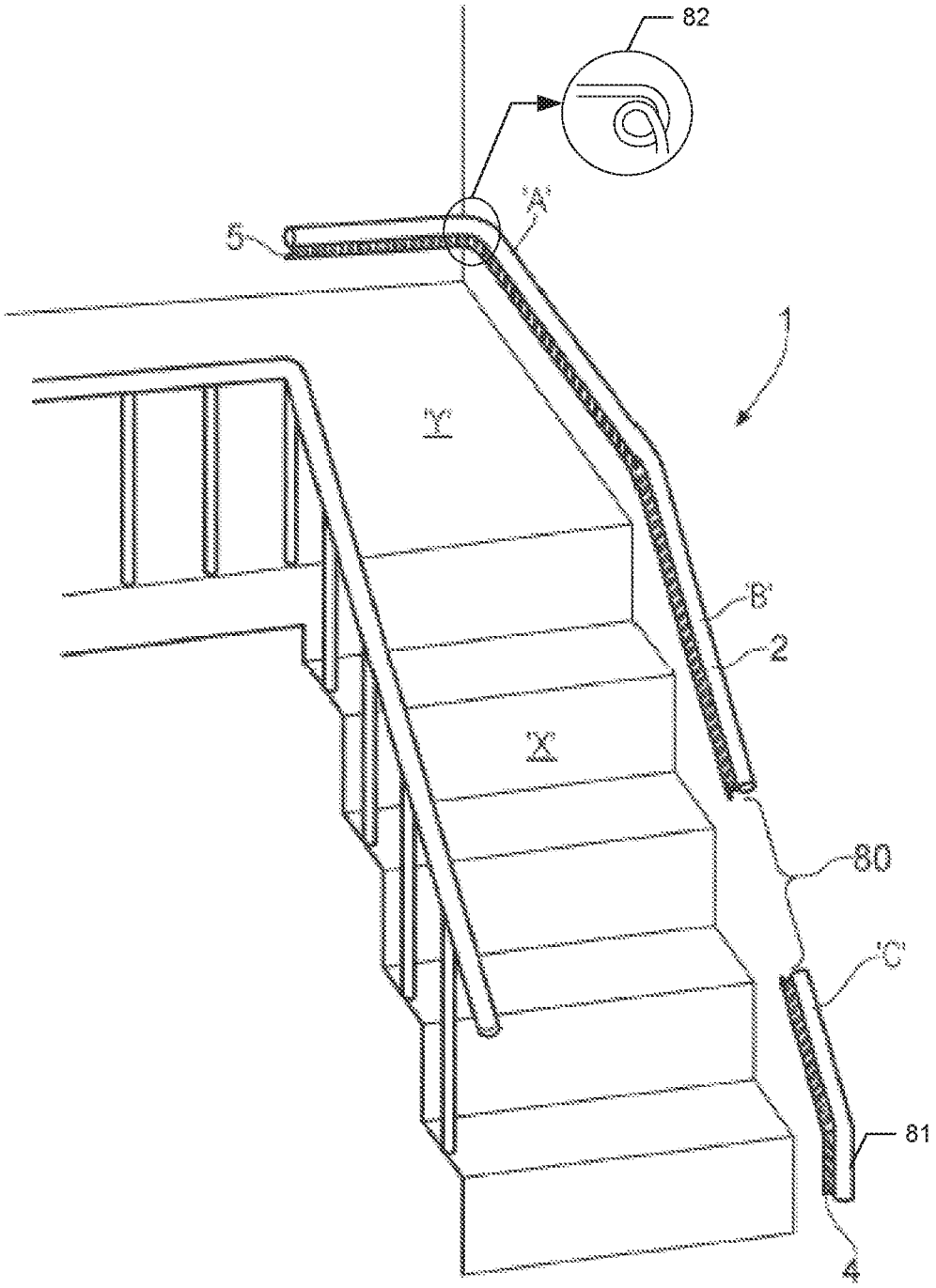
FIG. 8 shows apart installed stairlift guide rail prior to insertion of the stairlift.

For example, the curved bend section rail shown in FIG. 8 can be configure as a helical bend 82.

Figure 4A:
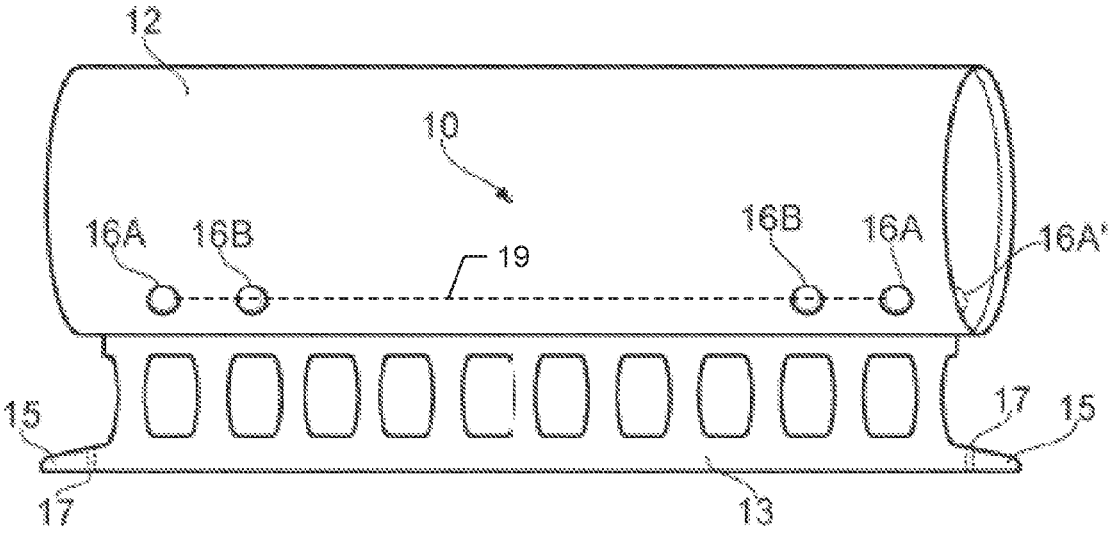
FIGS. 4A and 4B show different sections of guide rail according to embodiments.
Figure 4B:
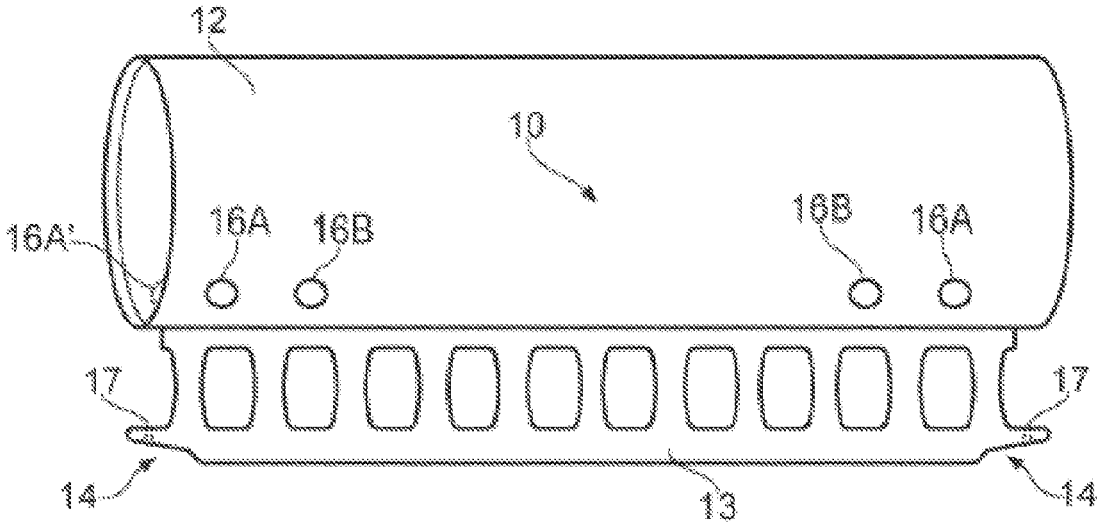

Referring now to FIGS. 4A and 4B, there is shown another section 10 according to embodiments of the present disclosure. Section 10 has a shaft 12 and a rack 13 located directly below the shaft 12. Rack 13 is positioned in the universal position so the first tooth and the open rack hole to the end of every section 10. When the end of the shaft section 10 meets with the other correct corresponding section of shaft, they meet at the centre line of the new rack hole that will be created when the two sections of rack are located together. FIG. 4A has two male protrusions, so a pin 6 is inserted through rack holes 7B and 17A to locate the male projection and the female recess. This ensures accurate positioning of rack 3 at the join. The pin may be a screw arrangement to securely fasten the two sections together. The male projection and the female recess are configured to engage with one another to form a contiguous rack when connected. This allows the stairlift unit, when mounted, to travel along the guide rail. As noted previously, the shortest length section of rail would be one rack hole. If this one rack hole section of rail was joined to the end of a section of rail with a female recess it would create a two hole rail extension. This would be the shortest joined extension possible. An end cap or other section could then be fitted. If a section of rail 12 (FIG. 4B) was used between the standard (female, male) (female, male) (female, male) (female, male) sections you can change the polarity of the sections. In other words, by inserting the section shown in FIG. 4B, the order of the sections is (female, male) (Female, Female) (male, female) (male, female). If the section of rail was a one rack hole section, then a three rack hole rail length would be created when fitted between two sections of rail. If required the rail system can be extended or shortened, or a bespoke section can be exchanged for a section of the installed stock range. This is made possible by having universal ends on all rail sections. By switching the polarity of the order of the sections, it is possible to rotate the left hand bend of section A in FIG. 1 to be a right hand bend.

Additionally provided within section 10 are the two shaft holes 16A and 16A' which are symmetrical about an edge. These two shaft holes 16A and 16A' are the same as shaft holes 9A and 9A' at the male projection end 5. Shaft holes 8A and 8A' at the female recess end 4 are the same shaft holes as 16A and 16A'. Shaft holes 9A and 9A', 8A and 8A' have been explained with reference to FIG. 3. Additionally shown in FIG. 4A and FIG. 4B is a second pair of shaft holes 16B and 16B' provided along the length of the shaft 12. Although only one second pair of shaft holes 16B and 16B' are shown, any number of additional shaft holes may be provided. For example, shaft holes may be provided along the length of the section or only along part of the section. These additional shaft holes do not need to be equally spaced and need not be continuous. As is seen in FIGS. 4A and 4B, additional shaft holes 16B and 16B' have their horizontal centreline being the same centre line as the main rack holes. However, the disclosure is not so limited. In the case that the horizontal centreline of the additional shaft holes 16B and 16B' is the same as the horizontal centreline of the main rack holes, the vertical centre line of the holes 16B will be a line that travels through the centres of holes 8A and 9A and runs parallel with the centre line of the rack position (Point Q). The vertical centre line of the holes 16B' will be a line that travels through the centre of hole 8A' and 9A' and runs parallel with the centre line of the rack position (Point Q).

The additional shaft holes 16B and 16B' can be used for various applications. The additional shaft holes can be used with the spigot where the sections of rails join together to make a very strong joint. In other words, the spigot may be secured to each section using the shaft hole 16A and 16A' and additional shaft holes 16B and 16B'. Additionally, the additional shaft holes 16B and 16B' can also provide the bracket support for the support leg (60) or wall mounting (D). Moreover, additional shaft holes 16B and 16B' can also be used with a spigot away from the join between two sections to provide the bracket supports for a support leg, charging points, stop points, securing the end cap (G) and securing the floor mounting (F), and/or holes to let wires into and out of the shaft.

Further, the additional shaft holes 16B and 16B' can also be used to emit light from a light tube kit 19 that can be inserted inside the shaft along the length of the completed guide rail as will be explained later.

For ease of production, these additional shaft holes will also be centred above the corresponding rack hole. This allows for the sections to be manufactured as long tubes with the rack attached and then cut to length during the manufacturing process.

Figure 5:
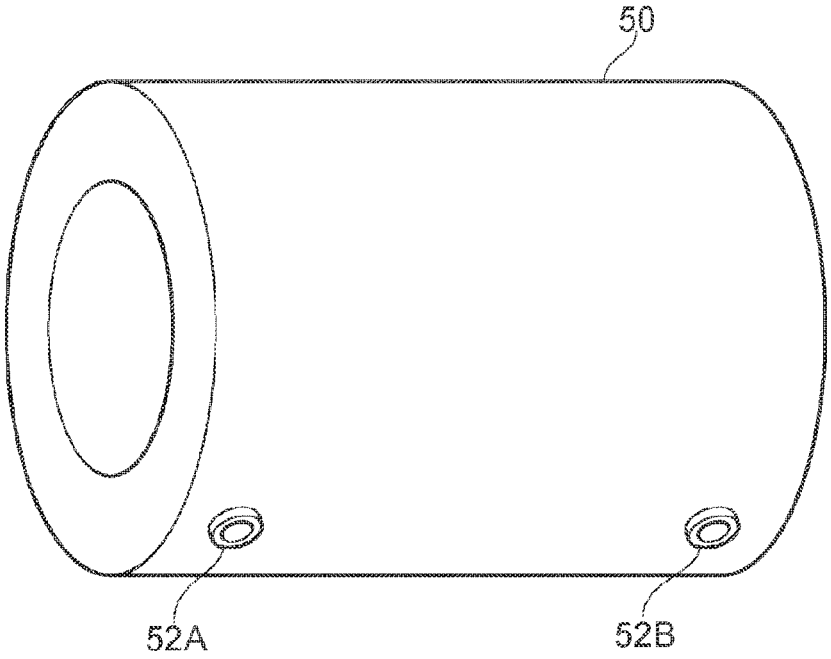
FIG. 5 shows a spigot that connects two sections together.

Referring now to FIG. 5, a spigot 50 according to embodiments of the disclosure is shown. The spigot 50 is a small length of material that is inserted into section 10 at one side. The diameter of the spigot is therefore slightly smaller than the diameter of section 10 to allow insertion of the spigot into the section 10. The spigot 50 also includes securing element (screw) receiving sections 52A and 52B which align with shaft holes 8A and 8B respectively in FIG. 3 and shaft holes 16A and 16A' in FIGS. 4A and 4B. The screw receiving sections 52A and 52B are configured to receive the securing elements (in embodiments, screws) 12A and 12B shown in FIG. 2. The screw receiving sections 52A and 52B may protrude from the spigot 50 or may be recessed within spigot 50. In embodiments, the screw receiving sections 52A and 52B are recessed to allow the outer surface of the spigot 50 to be smooth. This allows the spigot 50 to be easily inserted into section A or section B. As the screw receiving sections 52A and 52B are recessed, the thickness of the spigot 50 is, in embodiments, greater than the thickness of the guide rail sections. However, this is not always necessary as would be appreciated.

Additionally, although only a single screw recess section 52A and 52B is shown in FIG. 5 which would align with any shaft hole 8A, 9A or 16A, it is understood that a further set of screw recess sections will be provided in the spigot 50 to align with the holes positioned symmetrically about a point along one edge of the section. In other words, referring to FIGS. 4A and 4B, the screw receiving section 52A and 52B will have another set of screw receiving sections located on the spigot 50 to align with holes 16' as shown in FIG. 4A and FIG. 4B. This allows the spigot 50 to be used to connect any section together irrespective of orientation (i.e. left hand curvature or right hand curvature of the section). Moreover, it is understood that further receiving sections could be provided in spigot 50 to align with additional shaft holes on the same centre line at main rack hole centres. This allows short sections of rail to be accommodated by the spigot. There would be various length options for the spigot 50. Spigot 50 would not be handed as only one length of holes on either side of the rack would be used at one time.

Figure 6:
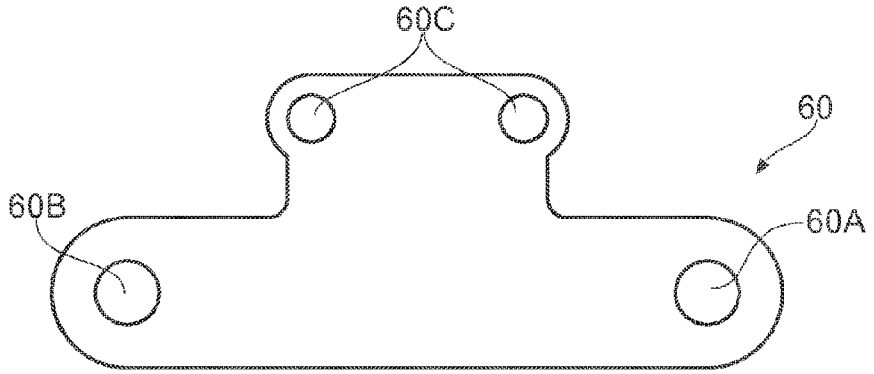
FIG. 6 shows a mounting bracket as used in FIG. 1.

Referring now to FIG. 6, a bracket 60 for mounting the guiderail to the floor is shown. In embodiments, the mounting bracket 60 is made of the same material and may be the same colour as sections A and B. The mounting bracket 60 has two mounting holes 60A and 60B which receives a screw to attach the mounting bracket 60 to the floor. Additionally provided are shaft mounting holes 60C which align with shaft holes 8A and 8B in FIG. 2 when sections A and B are attached together. When attaching the mounting bracket 60 to the joined sections, it is anticipated that the mounting bracket 60 will be attached to the two sections A and B using holes 60C. In other words, during installation of the guiderail, the two sections will be placed together over the spigot 50 so that shaft holes 8A and 8B align with screw recess section 52A and 52B, the mounting bracket 60 will be placed on the exterior of the conjoined sections so that shaft mounting holes 60C align with the shaft holes 8A and 8B and secured in place using screws 12A and 12B. Accordingly, the mounting bracket 60 will be secured to the guide rail sections A and B and into the spigot 50. Of course, although the mounting bracket 60 is described as fitting in shaft holes 8A and 8B, the mounting bracket 60 could equally be placed on the other side of the section.

It is important to note that with the provision of the shaft holes symmetrically about a point along one edge of the section allows the mounting bracket 60 to be placed on either side of the guiderail. This is important when considering the modular nature of the sections. Specifically, the provision of the two holes symmetrically about a point along one edge of the section allows the orientation of a section to be reversed without the position of the mounting bracket being changed. This is important because as would be appreciated when referring to FIG. 3 which shows a left hand bend (with the mounting bracket being attached to shaft hole 8A), the same section can be used as a right hand bend by simply attaching the mounting bracket to shaft hole 9A' as described. This means that a smaller number of parts are required to be made as a right hand bend can be rotated to also act as a left hand bend. Further, straight sections and helical sections of rail can be reversed. Therefore it is possible to make the mirror image of the complete stairlift assembly using the same parts. For example, the following can all be changed from a right hand set of rails to left hand set of rails by simply reversing the sections of rails:

Straight section of stairs, flat landing at the top, one 90 degree bend with one step to the side.

Straight section of stairs, two step fan at the top, one helical bend.

Straight section of stairs, three step fan at the top, one helical bend.

Straight section of stairs, two step fan, one helical bend, at top followed by another straight step.

Straight section of stairs, three step fan, one helical bend, at the top followed by a single step.

Straight section of stairs, flat landing at the top, one 90 degree bend, followed by two steps.

Straight section of stairs, flat landing, one 90 degree bend, followed at top by three steps.

One step, flat landing at the bottom, one 90 degree bend, followed by a straight flight.

Two step fan at the bottom, one 90 degree helical bend, followed by a straight flight.

Three step fan at bottom, one 90 degree helical bend, followed by a straight flight.

Straight flight, flat landing, one 90 degree bend, another straight flight, on to the top landing, then another 90 degree bend away from the stairs.

Straight flight up, onto straight flat landing, then down the other side.

Three fan step at the bottom, one 90 degree helical bend, straight section, followed by another three fan step, one 90 degree helical bend.

Straight flight, flat 180 degree landing, two separate 90 degree bends, followed by another straight flight.

Four step fan at the bottom, one 90 degree helical bend, followed by a straight flight.

Straight flight, six step fan, two separate 90 degree helical bends onto landing.

Spiral staircase.

Straight flight, door near the bottom of the stairs, straight onto landing at the top.

Horizontal start, straight flight, straight onto landing at the top.

Straight flight, four step fan at the top, one 90 degree helical bend, followed by a single step.

Straight flight, two step fan at the top, one 90 degree helical bend, followed by a two steps.

Straight flight, three step fan at top followed by two steps.

The same stairlift unit can also be used with this system.

Figure 7:
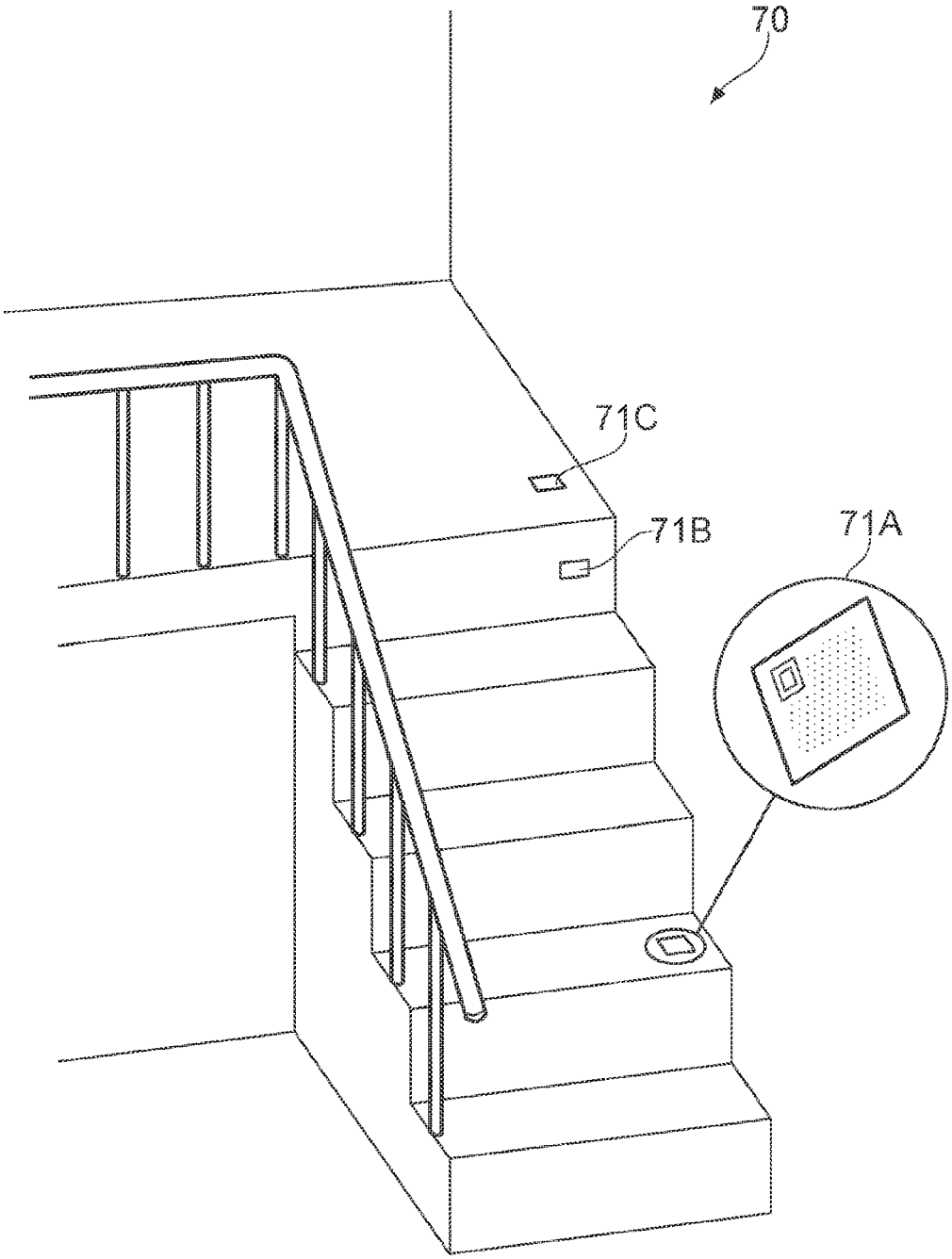
FIG. 7 shows a staircase during a survey.

Referring now to FIG. 7, an installation process will now be described. During installation, a survey is conducted at a customer's home. During the survey, a number of barcodes (referred to as QR coded targets) are placed at specific point on the stairs and in the locality of the stair. In the example shown in FIG. 7, a first target 71C is located on the landing area of the stairs. A second target 71B is located on the vertical part of the stair (sometimes called the "stair riser"). A third target 71A is positioned on the tread of the stair. As detailed in 71A with respect to the third target, each target placed may be a QR code. This allows more information to be stored compared to a traditional 2D target.

In embodiments of the disclosure, the target uniquely identifies one type of section to be installed at the target position. For example, first target 71C uniquely identifies a curved section with a length of 20 rack holes and two male projections to be installed at the same position as the target. Similarly, the second target 71B identifies a straight section with a length of 35 rack holes and one female and one male projection and the third target 71A uniquely identifies a loading section. The loading section will be explained later. The different sections will be positioned to centre on the position of the target.

In the system of FIG. 7, it is envisaged that any type of computer readable target be used during the survey procedure. The use a QR code is particularly advantageous as these are well known to be compatible with tablet computers and many applications are available that read QR code type targets.

During the survey, the operative uses a tablet computer to capture the image of the staircase with the QR codes correctly positioned. This will be used during installation to identify the position of each section. Further, as the QR code uniquely identifies the section, the tablet computer can connect to a server over the Internet and retrieve an image of the section. The tablet computer will then read the QR code and position, using augmented reality, the section over the real life scene of the stair case. This allows the surveyor and the customer to review the positioning of the guide rail in-situ. The customer may also approve the survey on the basis of the augmented reality image. Once approved, the survey system will produce a list of all the parts required to fit the stairlift kit. If all the parts required are with the surveyor then the stairlift can be installed. If all the parts required are not available at that time or the client wants to book an installation time. The information can be sent to the warehouse for processing. Using QR codes for the provision of augmented reality is well known to a person skilled in the art and so will not be described in any detail hereinafter.

Loading Section and Loading Device

Referring now to FIG. 8, a part installed guide rail is shown. In this Figure, a section 80 is missing from the installed guide rail. Additionally, the stairlift needs to be mounted on the rail. In traditional methods, the stairlift (which can weigh in excess of 35 kg) is carried to the top of the stairs and is inserted at point 5 on the guiderail. However, many injuries can occur due to carrying a very large and heavy device up the stairs. Moreover, in order to align the chair with the guiderail, many small movements are required in order to mount the chair on the guiderail. This is very difficult with a heavy device and is usually carried out by one person. According to embodiments of the disclosure, this problem is being addressed.

Figure 9:
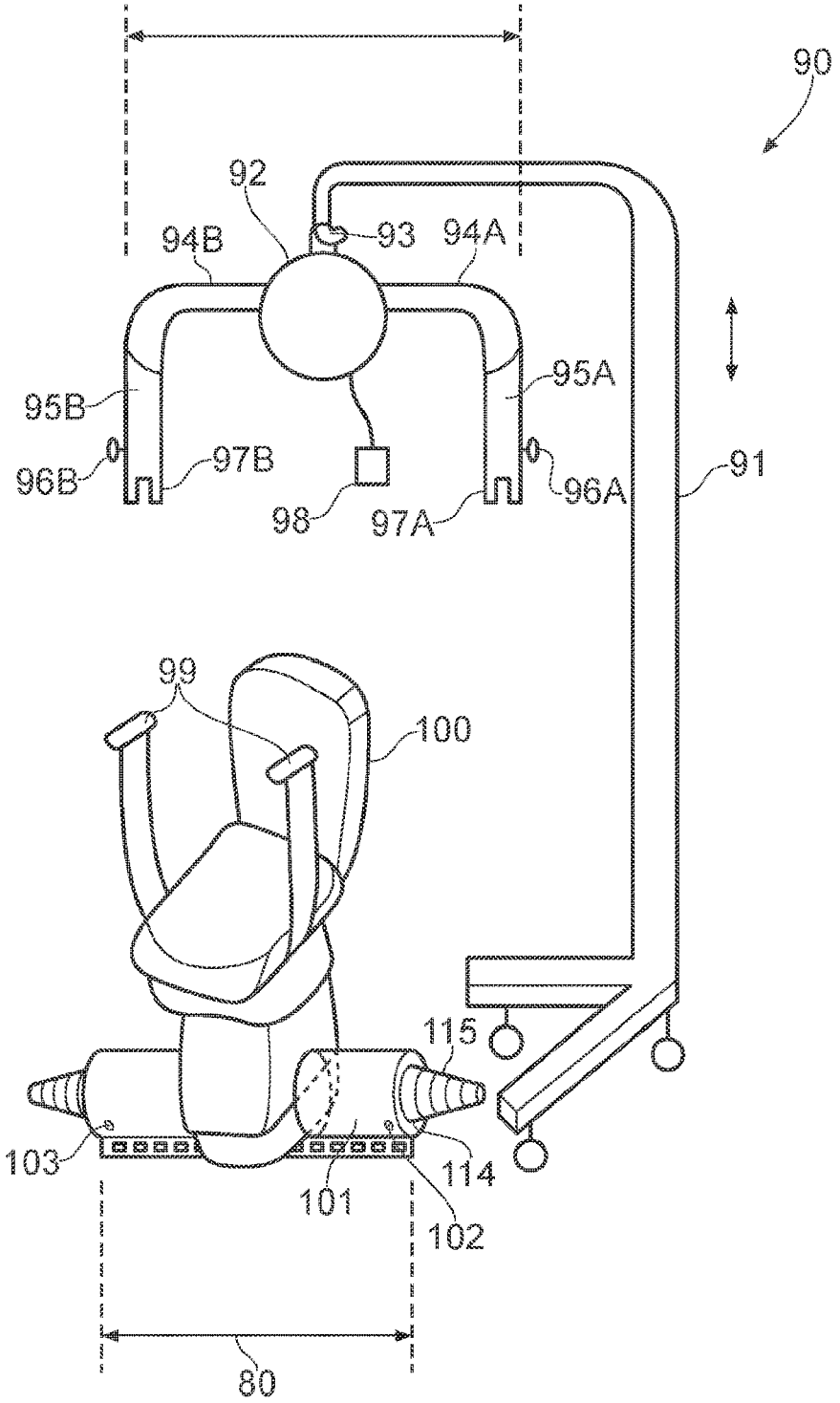
FIG. 9 shows a chairlift loader and loading section according to embodiments.

Referring to FIG. 9, a loading device 90 is shown. The loading device 90 consists of a hoist 91 which is mounted on casters so that it can be wheeled around. Typically, it is envisaged that the hoist will be used to lift the stairlift unit from its transport box once the stairlift unit box has been transported into the house. The legs on the hoist are short to allow the hoist to be positioned very close to the lowest step in FIG. 8. The hoist is adjustable in the height direction as indicated by the vertical arrows in FIG. 9. Attached to the hoist is a clip 93. The clip 93 is fixedly attached to the hoist to allow items to be easily attached and detached from the hoist 91.

A loading apparatus 92 is shown attached to the hoist. The loading apparatus 92 comprises a central body having two arms 94A and 94B fixedly attached to the central body in the horizontal direction. Attached to the two arms 94A and 94B are clamps 95A and 95B. Clamps 95A and 95B have jaws 97A and 97B that can be opened or closed using the screw mechanism 96A and 96B.

In operation, the arms 94A and 94B are adjusted in the horizontal direction as indicated by the horizontal arrow in FIG. 9. This allows the distance between the jaws 97A and 97B in the horizontal direction to be adjusted. In particular, in use, the jaws 97A and 97B clamp around the arms of the stairlift unit 100. Therefore, the arms 94A and 94B are adjusted in the horizontal direction so that the horizontal distance between the jaws 97A and 97B align with the arms of the stairlift unit 100.

The loading apparatus 92 is controlled using a control unit 98. In the system shown in FIG. 9, the loading apparatus 92 is controlled using a wired connection. However, it is envisaged that the central body could be controlled using a wireless connection such as a Bluetooth connection. Moreover, if the central body is controlled using a RS232 serial port, a tablet computer can control the central unit using a RS232 to Bluetooth adapter provided by www.get-console-.com.

Figure 10:
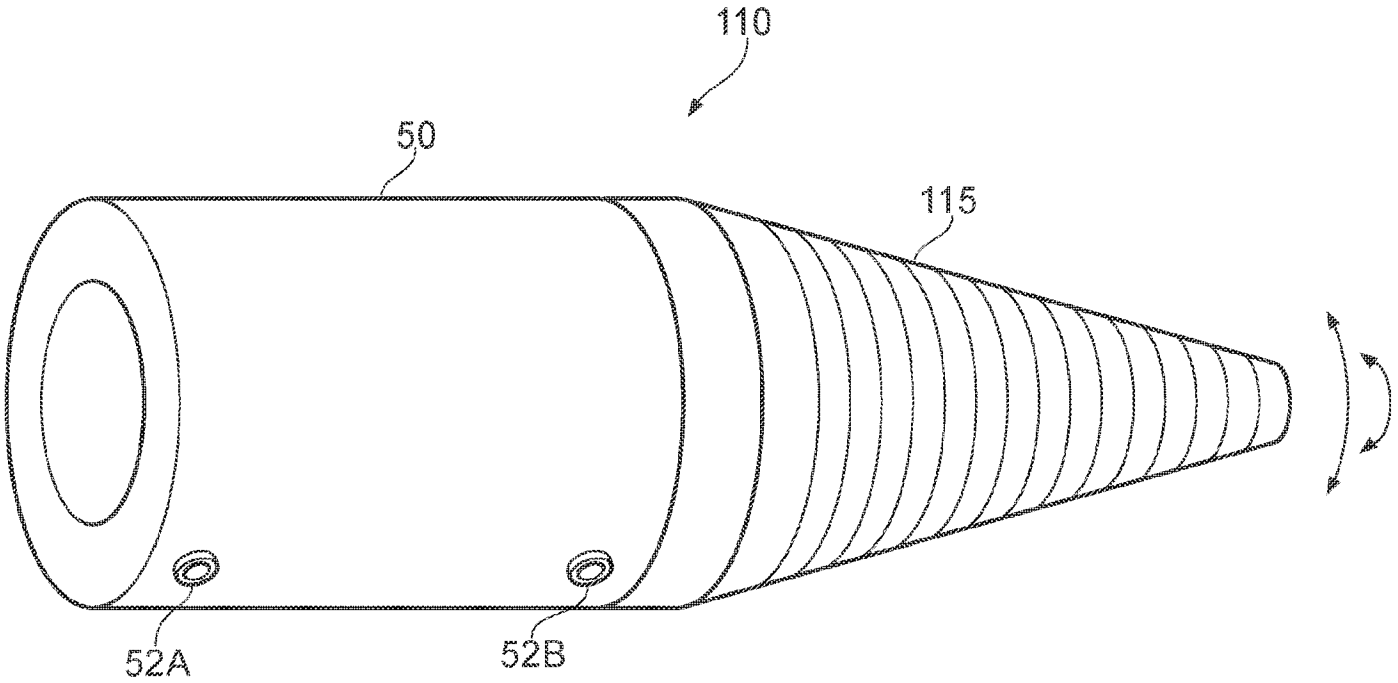
FIG. 10 shows a loading tube according to embodiments.

As will be evident from FIG. 9, the stairlift unit 100 is mounted on a loading tube 101. The loading tube is a modular section that has a length 80 which corresponds to the length of the gap shown in FIG. 8. Attached to the loading tube is a modified spigot which will be shown in more detail with reference to FIG. 10. The spigot is screwed in position in shaft holes 102 and 103. The modified spigot has a bendable and extended section 115 which inserts into either end of sections B and C. The provision of the loading tube means that the stairlift unit 100 can be easily attached to the loading tube in the delivery vehicle. This is because the stairlift unit 100 may be held stationary whilst the small piece of loading tube 101 is inserted into the drive mechanism of the stairlift unit. Advantageously, this removes the need to carry the stairlift unit 100 up the stairs and attach it at point 5 to the guiderail.

During use, the height of the hoist 91 is reduced and the horizontal length of arms 94A and 94B is adjusted so that the arms 99 of stairlift unit 100 align with the jaws 97A and 97B. The user then tightens the jaws so that the arms of the stairlift unit 100 are held in the teeth and the hoist is then lifted. The hoist is maneuvered in to the loading bay at the bottom of the stairs so that the hoist is positioned near to the loading area 80.

Figure 11:
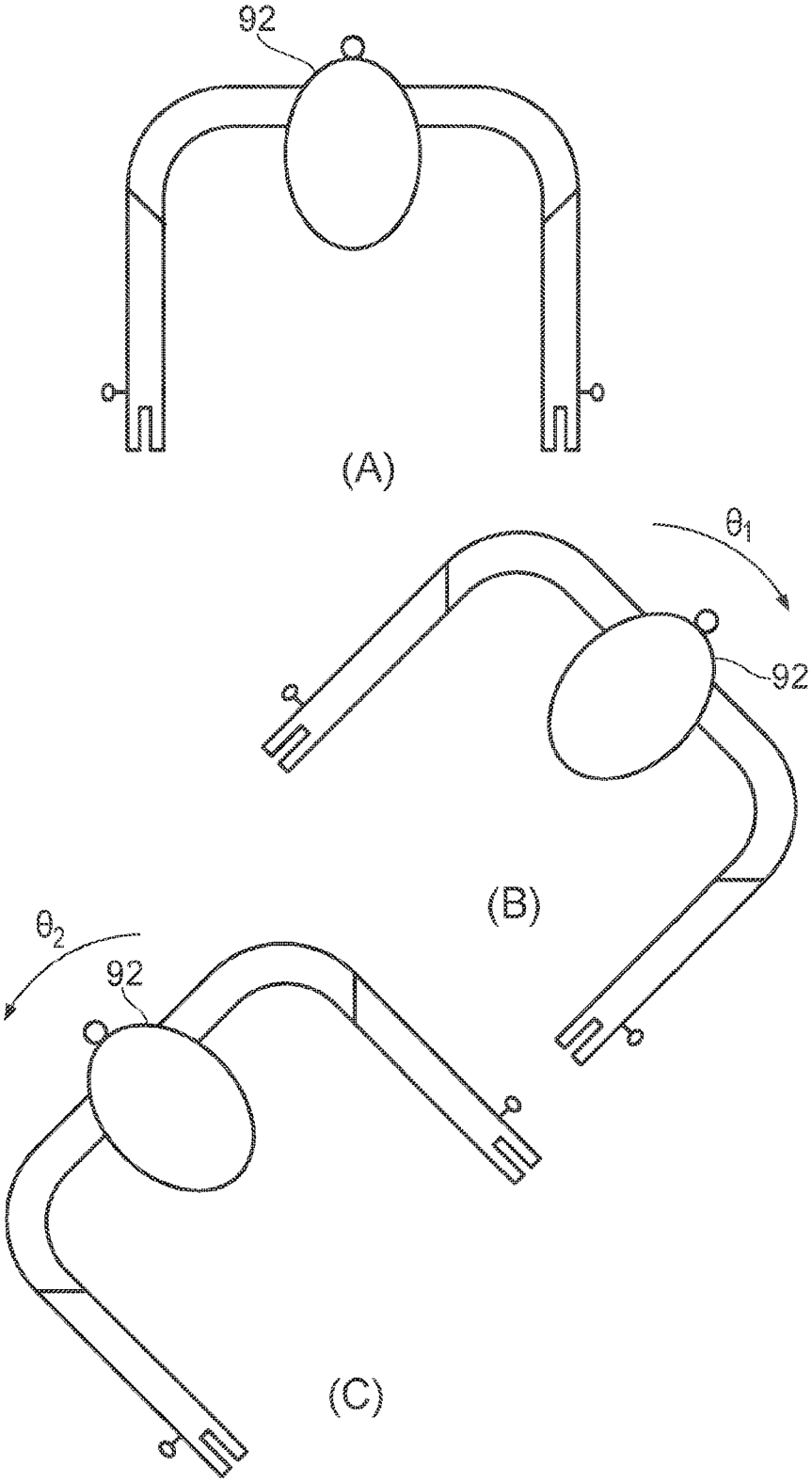
FIG. 11 shows the loading device as angled to allow insertion of the chairlift into the rail.

Referring to FIG. 11, the loading apparatus 92 is shown in more detail. Specifically, the loading apparatus 92 is shown in the horizontal position in section A. In part B of FIG. 11, the loading apparatus 92 is rotated by angle θ1 in the clockwise direction. The loading apparatus is rotated by an electric meter or the like (not shown) under the control of the control unit 98. It should be noted here that the loading apparatus 92 rotates about the central section. This means that when a stairlift unit is loaded into the jaws, the loading tube will also be angled at θ1 in the clockwise direction.

Similarly, in part C of FIG. 11, the loading apparatus 92 is rotated in the anticlockwise direction by θ2. Again, this rotation is about the central section. Accordingly, by altering the angle of rotation of the loading apparatus 92, the angle of the loading tube 101 is adjusted. Therefore, the loading tube 101 can be angled to align with section B and C in FIG. 8. Therefore, when the hoist 91 is lowered, the loading tube 101 simply slots into the gap 80 between section B and section C of FIG. 8.

The stairlift unit has the loading tube 101 and the mounting bracket 92 fitted at the factory during the stairlift units assembly. The hoist is connected using clip 93 to the stairlift unit lifting bracket 92, then the stairlift unit is lifted from the transport box. Control unit 98 is plugged into the stairlift unit, so the installer can control the forward and backward movement of loading tube 101. They can adjust the vertical angle (positive or negative) of the loading tube. They can also use the stairlift powered swivel seat motor to rotate the stairlift unit clockwise or anti clockwise. Therefore, the loading tube 101 can be angled to align with the section of rail it will be loaded onto.

In order to help guide the loading tube into position, a modified spigot is used. The modified spigot 110 is shown in more detail in FIG. 10. The modified spigot has similar components to those of the spigot 50 shown in FIG. 5. Those similar components have the same reference numerals and will not be described in any further detail.

However, in addition to those similar components, a bendable (flexible) protrusion 115 is attached to one end of the spigot 50. This was shown in FIG. 9. The flexible protrusion 115 may be made of plastic or rubber and can be manipulated in the vertical and horizontal directions. When loading the loading tube 101 into area 80, the installation engineer will bend and manipulate the flexible protrusion 115 to engage with the ends of section B and section C of FIG. 8. This allows the stairlift unit 100 to be located in position and the loading tube 101 to be attached to section B and C respectively. After installation and insertion the loading tube, the stairlift unit can be used as required.

Installation Process

Figure 12:
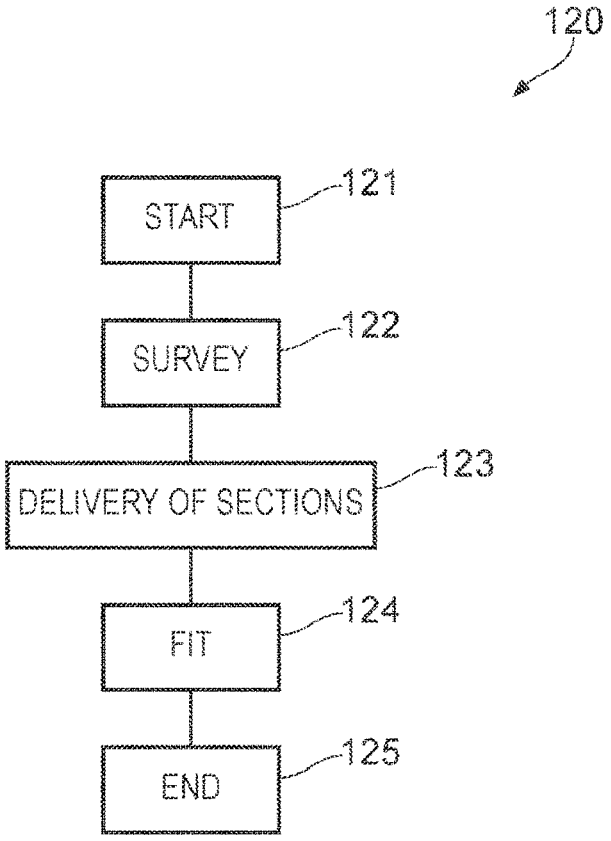
FIG. 12 shows a flowchart explaining the installation process according to embodiments.

Referring now to FIG. 12, a flowchart explaining the installation process 120 is shown. The flowchart starts at step 121 whereby a surveyor visits the site. The surveyor conducts a survey in step 122. The survey 122 may use a traditional surveying technique as known to the skilled person. Alternatively, according to an embodiment of the disclosure, a new surveying technique may be used as explained with reference to FIG. 13.

After the survey, the stairlift kit can be installed or the kit can be ordered directly from the warehouse and delivered to the customer's house in step 123. An installation engineer then visits the customer's house and installs the stairlift unit and the associated guiderail in step 124. Process 124 is explained in more detail with reference to FIG. 14. The installation process then ends at step 125.

Figure 13:
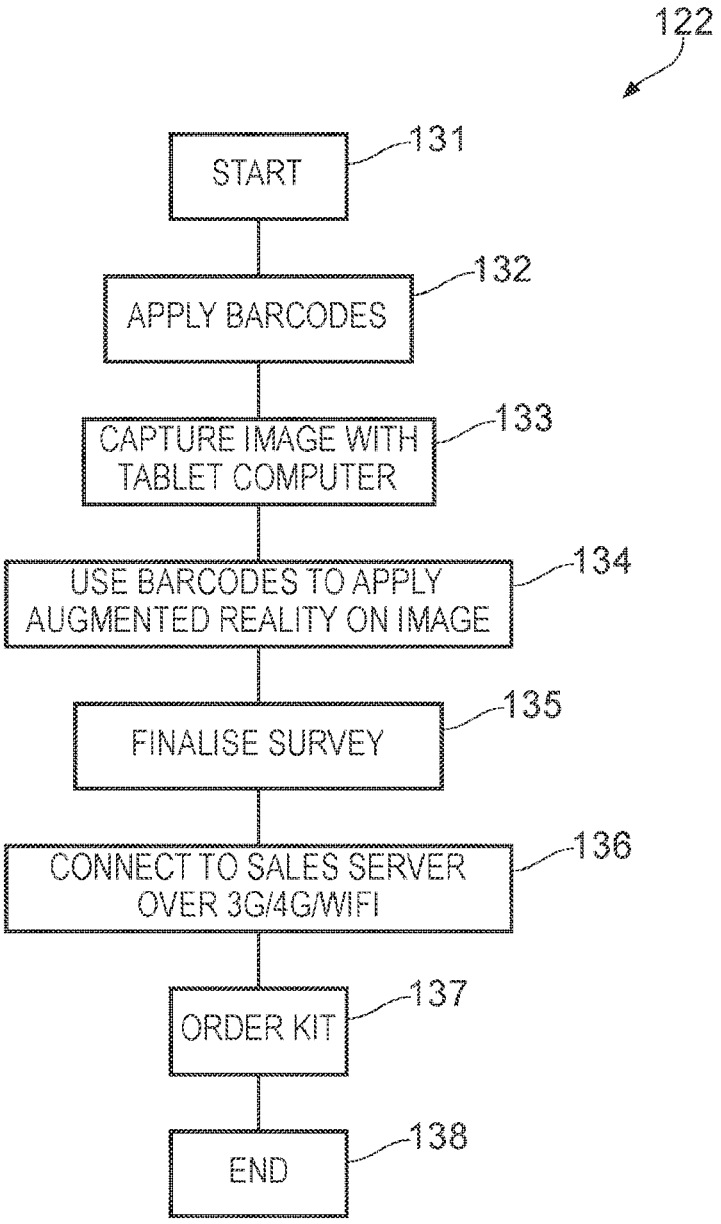
FIG. 13 shows in detail the survey flowchart of FIG. 12.

Referring to FIG. 13, the survey step 122 of FIG. 12 is described in more detail. The process starts at 131 when the surveyor arrives at the customer's premises. The surveyor then places the QR code on certain areas within the stair environment. This is step 132. In embodiments of the disclosure, the QR codes that are applied indicate the section to be used. The position of the section to be used is centred at the position at which the QR code is placed. In other words, in FIG. 7, the position of QR code 71A indicates the centre position of the loading tube. Similarly, the QR code located at position 71C uniquely identifies which section is to be located at that position (which in this case is a left hand bend).

The surveyor having positioned the various QR codes then captures the image of the staircase with the QR codes attached thereto with a tablet computer. This is done in step 133. In addition to capturing a still image of the location, if the tablet computer is connected to the internet (or if the images of the various sections are stored on the tablet computer), the QR codes are used to apply augmented reality on a live image of the stair case. This is step 134.

In order to perform this, the QR codes indicate a certain section that will be used in the installation. If connected to the Internet, the image for that section is retrieved from a server. During the augmented reality procedure, the segment is then overlaid over the image being captured by the tablet computer. Augmented reality on a tablet computer is well known in the art and will not be described herein.

As the user can see the finished product using the augmented reality, the user is able to finalise the survey in step 135 and approve the installation of the stairlift unit and the guide rail. This is step 135.

The tablet computer then connects to a sales server in step 136 over either a cellular or WiFi network. After connection to the sales server, the sections which have been displayed in the augmented reality image are ordered from the sales server in step 137. The surveying procedure then ends at step 138.

In a traditional photo survey, a surveyor attends a site and applies coded markers. These markers indicate architectural features which need to be considered when designing the bespoke guiderail. The coded markers are traditionally used to produce a scale drawing of the stair case and a design scale drawing for the stairlift unit and rail which is sent to the customer for approval. After the user has approved the design document, the bespoke system is manufactured. This process can take many days or weeks.

In the above described system according to embodiments, however, as the modular sections each have a unique target allocated thereto, it is possible to not only allow the user to visualise the installed stairlift system using augmented reality, but it is also possible to instantly identify all the component parts (in the form of a kit) which can be installed for the customer immediately if the parts are on the van. Alternatively, if the stairlift kit needs to be ordered from the warehouse, it will be ordered instantly and delivered and installed the next day. This shortens the lead time between survey and fit.

Figure 14:
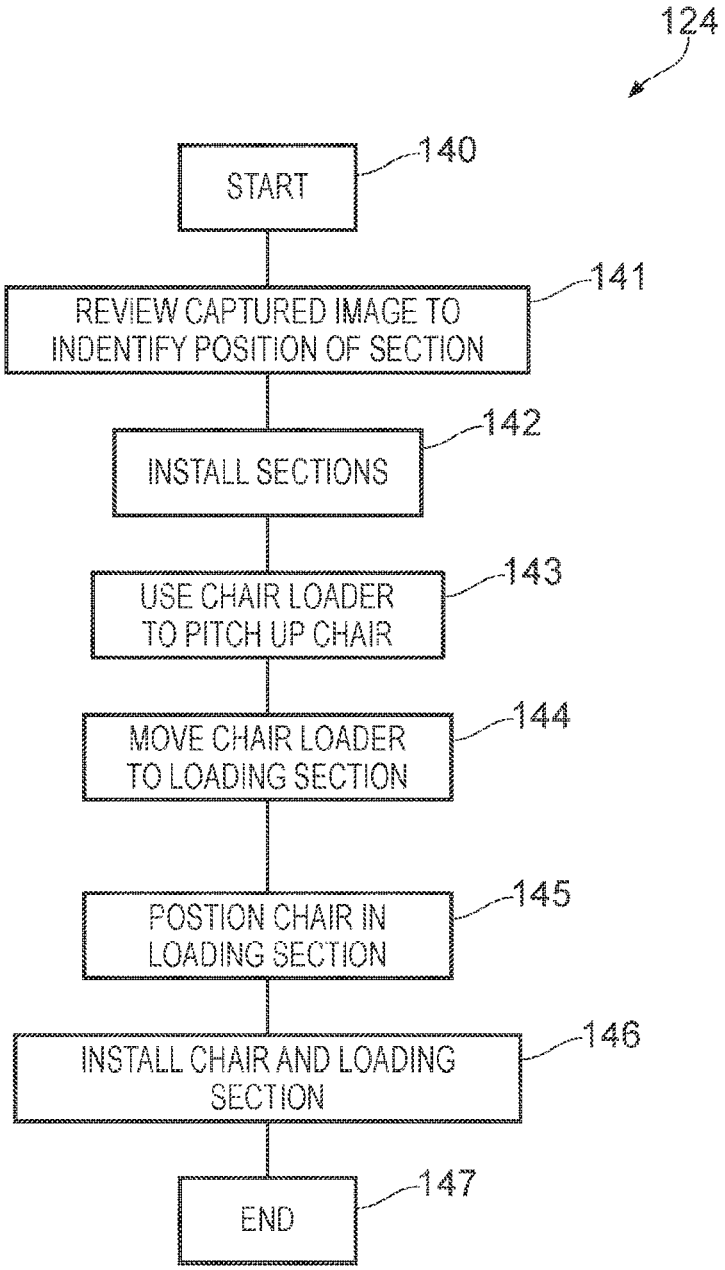
FIG. 14 shows the fitting step of FIG. 12 in more detail.

Referring now to FIG. 14, the installation process 124 is described in more detail. The installation process starts at step 140. The installation engineer reviews the captured image to identify the position of the relevant sections in step 141. As noted above, the centre of each section is located at the QR code position. These sections are installed using mounting brackets and the spigots in step 142. The hoist 91 is then used to pick up the stairlift unit 100 in step 143. The hoist 91 is positioned adjacent the loading section 80 and the stairlift unit loading apparatus 92 is rotated so that the loading tube 101 aligns with section A and B. The stairlift unit is then lowered into position and the loading section is secured to the remainder of the guiderail. These are steps 143, 144, 145 and 146 respectively.

The installation process then ends at step 147.

During the installation process, a light tube 19 may be installed along the length of the guiderail. The light tube 19 aligns with holes along the length of the guiderail. These holes may be holes 16 as shown in FIG. 4A or 4B or additional holes may be made in the tubing. By aligning the light tube 19 with the holes, the light effect may be provided along the guiderail. This may be to allow a decorative feature to be provided by the guiderail. Alternatively, a strobe effect can be provided along the length of the guiderail which indicates the direction of travel of the stairlift unit. This may be supplemented or replaced by different coloured lights. For example, traveling down the guide rail a green light may be shown through the holes and travelling up the guide rail a red light may be shown through the holes. Alternatively, if the stairlift unit is travelling down the guide rail the strobe may be in direction of down the stairs and if the stairlift unit is travelling up the stairs then the strobe effect may be in the direction of up the stairs. Also, if there is a power supply problem with the stairlift, the lights may flash red or the like.

The light tube may be installed from the top of the guide rail (i.e. inserted at position 5 in FIG. 8).

It is expected that the light tube and various sections, mountings and spigots will form part of a kit that is installed and delivered to a customer's home. The kit may also be stored by a provider of the guiderail sections or indeed a number of the same section may be referred to as a kit.

The guiderail sections may be made of any material such as steel or plastic or any kind of suitable compound.

Obviously, numerous modifications and variations of the present disclosure are possible in light of the above teachings. It is therefore to be understood that within the scope of the appended claims, the invention may be practiced otherwise than as specifically described herein.

The invention claimed is:

1. A section of a stairlift guide rail comprising:

two holes configured to attach to a second section of the stairlift guide rail, wherein the two holes are positioned symmetrically about a point along one edge of the section, wherein at least one of the two holes is further configured to couple to a bracket for mounting to the stairlift guide rail; and a rack having a plurality of rack holes, wherein the plurality of rack holes defines the smallest distance travelled by a stairlift, and wherein the center of each of the two holes align with the center of one of the plurality of rack holes.

2. The section according to claim 1, wherein the section has a circular cross-section.

3. The section according to claim 1, wherein the section is configured to receive a spigot which attaches the section to the second section.

4. The section according to claim 3, wherein one of the two holes is configured to align with a corresponding hole in the spigot, and the one of the two holes is configured to receive a securing element which engages the corresponding hole in the spigot.

5. The section according to claim 1 having a horizontal curvature.

6. The section according to claim 1 having a vertical curvature.

7. The section according to claim 1 having a helical curvature.

8. The section according to claim 1, wherein the section is straight.

9. The section according to claim 1, further comprising
a rail shaft, wherein the two holes are in the rail shaft and the rack extends along the rail shaft section.

10. A kit for the assembly of a stairlift guide rail, the kit comprising:
a plurality of sections of stairlift guide rail, each section having
two holes configured to attach to another section,
wherein the two holes are positioned symmetrically about a point along one edge of the section,
wherein at least one of the two holes is further configured to couple to a bracket for mounting to the stairlift guide rail; and
a rack having a plurality of rack holes,
wherein the plurality of rack holes defines the smallest distance travelled by a stairlift, and
wherein the center of each of the two holes align with the center of one of the plurality of rack holes.

11. The kit according to claim 10, further comprising a light tube configured to extend along the length of section and having a lighting element configured to align with one of the two holes.

12. The kit according to claim 10, wherein each section has a circular cross-section.

13. The kit according to claim 10, further comprising
a spigot which attaches two sections of the plurality of sections together.

14. The kit according to claim 13, wherein one of the two holes of each of the sections is configured to align with a corresponding hole in the spigot and to receive a securing element which engages the corresponding hole in the spigot.

15. The kit according to claim 10, wherein the plurality of sections includes a section having a horizontal curvature.

16. The kit according to claim 10, wherein the plurality of sections includes a section having a vertical curvature.

17. The kit according to claim 10, wherein the plurality of sections includes a section having a helical curvature.

18. The kit according to claim 10, wherein the plurality of sections includes a straight section.

19. The kit according to claim 10, wherein each of the plurality of sections includes a rail shaft section, wherein the two holes are in the rail shaft section and the rack extends along the rail shaft section.

* * * * *